United States Patent [19]

Matsuki

[11] Patent Number: 4,926,528

[45] Date of Patent: May 22, 1990

[54] BUCKLE FOR SEAT BELT SYSTEM

[75] Inventor: Masuo Matsuki, Chigasaki, Japan

[73] Assignee: Nippon Seiko Kabushiki Kaisha, Tokyo, Japan

[21] Appl. No.: 407,041

[22] Filed: Sep. 14, 1989

[30] Foreign Application Priority Data

Sep. 21, 1988 [JP] Japan ..... 63-122765[U]

[51] Int. Cl.[5] ..... A44B 11/26

[52] U.S. Cl. ..... 24/640; 24/641

[58] Field of Search ..... 24/640, 641, 642, 633, 24/639

[56] References Cited

U.S. PATENT DOCUMENTS

| | | | |
|---|---|---|---|
| 4,068,354 | 1/1978 | Loomba et al. | 24/641 |
| 4,358,879 | 11/1982 | Magyar | 24/641 |
| 4,451,958 | 6/1984 | Robben et al. | 24/641 |
| 4,543,693 | 10/1985 | Cunningham | 24/640 |
| 4,577,378 | 3/1986 | Harenberg | 24/635 |
| 4,597,141 | 7/1986 | Wier | 24/633 |

FOREIGN PATENT DOCUMENTS

3128139 C2 8/1983 Fed. Rep. of Germany .

*Primary Examiner*—Victor N. Sakran

*Attorney, Agent, or Firm*—Wegner & Bretschneider

[57] ABSTRACT

A buckle for a seat belt system is disclosed. The buckle includes a buckle base, a buckle button provided movably in parallel with the length of the buckle base and defining in association with the buckle base a clearance through which an associated tongue plate may be inserted into the buckle, a cover, and a button spring provided between the cover and the buckle button for applying a spring force against the buckle button in a direction to push out the buckle button. The buckle button is provided with a tiltable member, which has a seat portion receiving an outer end portion of the button spring thereon and a suppressing portion projecting into the clearance from the seat portion.

5 Claims, 2 Drawing Sheets

BUCKLE FOR SEAT BELT SYSTEM

BACKGROUND OF THE INVENTION (1) Field of the Invention

The present invention relates to an improvement in a buckle for a seat belt system provided to protect an occupant in a vehicle seat in the event of a collision. The buckle is assembled in the seat belt system, so that the buckle receives therein an associated tongue plate in a latched state when the seat belt system is used. The above improvement has made it possible to prevent the production of unpleasant noise which otherwise tends to occur due to rattling of the tongue plate upon its latching on the buckle.

(2) Description of the Related Art

To protect an occupant in the event of a collision or a similar accident, a vehicle seat is provided with a seat belt system such as that illustrated in FIG. 5.

Upon use of such a seat belt system, a tongue plate 2 to which a webbing 1 is fastened is latched on a buckle 4 connected to a flexible wire 3 to restrain an unillustrated occupant by the webbing 1. Accordingly, the occupant in a seat 5 is prevented from being thrown forward even in the event of a collision. Upon egress, the occupant presses a buckle button of the buckle 4 to release the latching between the tongue plate 2 and the buckle 4 so that the webbing 1 no longer prevents the occupant from leaving the seat 5.

To date, a variety of constructions have been used to provide such buckles. However, the basic structure is composed, as shown in FIG. 6 by way of example, of a buckle base 6 made of a metal plate, a buckle button 7 movable in parallel with the length of the buckle base 6 to move a buckle latch piece (not shown in FIG. 6) and hence to release the latching between the buckle 4 and tongue plate 2, and a two-piece cover 8 substantially enclosing the buckle button 7 and buckle base 6.

The cover 8 defines an opening 9 through which a portion of the buckle button 7 is selectively movable back and forth. In the opening 9, a clearance 10 having a width greater than the thickness of a proximal end portion of the tongue plate 2 is defined between the upper surface of an outer end portion of the buckle base 6 and the buckle button 7 so that the proximal end portion of the tongue plate 2 may be inserted into the buckle 4.

Provided between the cover 8 or a support 11, said support being fixed relative to the buckle base 6, and an inner side wall 12 of the buckle button 7 is a compression spring as a button spring 13, whereby an outward spring force is exerted against the buckle button 7.

To latch the tongue plate 2 on the buckle 4 constructed as described above, insertion of the proximal end portion of the tongue plate 2 into the clearance 10 causes an unillustrated buckle latch piece, which is supported on the buckle base 6, to automatically advance into a slot 14 formed in the vicinity of the proximal end of the tongue plate 2 under the spring force of a spring (not shown either), so that the buckle latch piece prevents separation of the buckle 4 and tongue plate 2 from each other.

To release the latching between the buckle 4 and the tongue plate 2 upon egress, it is simply necessary to press the buckle button 7 of the buckle 4 against the spring force of the button spring 13. As a result, the buckle latch piece is caused to retreat from the slot 14 of the tongue plate 2 to render the tongue plate 2 ready to be withdrawn from the inside of the buckle 4. In practice, the tongue plate 2 is ejected out from the buckle 4 by means of a ejector spring.

Conventional buckles for seat belt systems, which have been constructed as described above, are however accompanied by the inconvenience set out next.

The width W of the clearance 10 defined between the buckle base 6 and the buckle button 7, more precisely, between the lower edge of the opening 9 formed in the cover 8 and the lower surface of the buckle button 7 as shown in the drawing has to be greater than the thickness T of the tongue plate 2 to ensure easy insertion of the tongue plate 2 into the buckle 4 ($W > T$). The above definition for the clearance 10 will apply equally to all clearances to be referred to hereinafter.

However, when the width W of the clearance 10 is designed greater than the thickness T of the tongue plate 2 as mentioned above, the tongue plate 2 tends to rattle inside the buckle 4 upon latching of the tongue plate 2 on the buckle 4. The tongue plate 4 and buckle base 6 are both made of metal. The noise caused by hitting of the tongue plate 2 and buckle base 6 against each other may therefore be unpleasant to the occupant.

With a view toward solving such an inconvenience, DE 31 28 139 C2 published Aug. 18, 1983 proposes to cover the tongue plate 2 with a synthetic resin so that even when the tongue plate 2 rattles inside the buckle 4 no intermetal hitting would take place, thus avoiding any unpleasant noise.

Covering of the tongue plate 2 with a synthetic resin as proposed in the German patent publication however inevitably leads to a substantially higher manufacturing cost although noise production may be prevented to a certain extent.

On the other hand, U.S. Pat. Nos. 4,577,378 and 4,597,141 issued Mar. 25 and July 1, 1986 respectively propose to form at a part of the cover 8 a resilient portion which extends into the opening 9. The resilient portion serves to suppress the tongue plate 2 inserted into the buckle 4, whereby the tongue plate 2 may be prevented from rattling inside the buckle 4.

The integral formation of the resilient portion with the cover 8 made of a synthetic resin however results in a higher cost for the fabrication of a mold therefor. This increases the manufacturing cost of the buckle 4. In addition, the resilient portion has the potential problem that it could be damaged while the tongue plate 2 is repeatedly inserted into and withdrawn from the buckle 4. Damage of the resilient portion then leads to the problem that the resilient portion is no longer effective for the prevention of noise.

SUMMARY OF THE INVENTION

An object of this invention is to solve the above-mentioned various problems of conventional buckles.

In one aspect of this invention, there is thus provided a buckle for a seat belt system. The buckle includes a buckle base; a buckle button provided movably in parallel with the length of the buckle base, adapted to drive a buckle latch piece upon parallel movement thereof and defining in association with the buckle base a clearance through which an associated tongue plate may be inserted into the buckle; a cover defining an opening through which a portion of the buckle button is selectively movable back and forth and enclosing therein the buckle button and buckle base except for a surface area of the buckle button, said surface area being exposed through the opening; and a button spring provided between the cover and the buckle button for applying a spring force against the buckle button in a direction to push out the buckle button. The buckle button is provided with a tiltable member which has a seat portion receiving an outer end portion of the button spring thereon and a suppressing portion projecting into the clearance from the seat portion.

In another aspect of this invention, there is also provided a buckle similar to the above-described buckle except that the button spring is placed between the buckle button and the buckle base instead of the cover.

In a further aspect of this invention, there is also provided a buckle for a seat belt system. The buckle includes a buckle base; a buckle button provided movably in parallel with the length of the buckle base, adapted to drive a buckle latch piece upon parallel movement thereof and defining in association with the buckle base a clearance through which an associated tongue plate may be inserted into the buckle; and a cover defining an opening through which a portion of the buckle button is selectively movable back and forth and enclosing therein the buckle button and buckle base except for a surface area of the buckle button, said surface area being exposed through the opening. An inner side wall of the buckle button is formed as a surface tilted toward the opening of the cover as the clearance is approached. A suppressing member is provided inside the buckle button. The suppressing member is slidable along the tilted surface and when moved to a maximum extent toward the clearance, projects at a portion thereof into the clearance, and a biasing member is provided to bias the suppressing member toward the inner side wall of the buckle button.

In the buckle according to each of the above three aspects of this invention, the tiltable or suppressing member resiliently suppresses the tongue plate to prevent the tongue plate from rattling inside the buckle, thereby preventing producing of any unpleasant noise. The buckle is simple in structure and can be manufactured at a relatively low cost. Because of its high-durability structure, the buckle can prevent over a long period of time the production of a noise which would otherwise take place because of rattling of the tongue plate inside the buckle.

Namely, in the case of the buckles according to the former two aspects of this invention, insertion of the proximal end portion of the tongue plate into the clearance of the buckle causes the tongue plate to push back the suppressing portion of the tiltable member. The tiltable member thus undergoes tilting against the spring force of the button spring, so that the suppressing portion is caused to retreat back from the clearance. This permits insertion of the proximal end portion of the tongue plate into the buckle.

Since the spring force of the button spring is always applied to the tiltable member, the suppressing portion of the tiltable member resiliently presses the tongue plate toward the buckle base even after the buckle latch piece provided on the side of the buckle advances into a slot of the tongue plate and tightly connects the buckle and tongue plate together.

As a result, the tongue plate does not rattle inside the buckle, thereby preventing the production of any unpleasant noise.

In the case of the buckle according to the last-mentioned aspect of this invention, insertion of the proximal end portion of the tongue plate into the clearance of the buckle causes the tongue plate to push back a portion of the suppressing member. The suppressing member is hence caused to move along the aslant surface of the inner wall of the buckle button against the outward spring force. The portion of the suppressing member is therefore caused to retreat from the clearance. This also permits insertion of the proximal end portion of the tongue plate into the buckle.

Since the outward spring force is always applied to the suppressing member, the portion of the suppressing member resiliently presses the tongue plate toward the buckle base even after the buckle latch piece on the side of the buckle advances into the slot of the tongue plate and the buckle and tongue plate are tightly connected together.

As a result, the tongue plate does not rattle inside the buckle, thereby preventing the production of any unpleasant noise.

BRIEF DESCRIPTION OF THE INVENTION

The above and other objects, features and advantages of the present invention will become apparent from the following description of the invention and the appended claims, taken in conjunction with the accompanying drawings, in which:

FIGS. 1 and 2 show a buckle according to a first embodiment of this invention, in which FIG. 1 depicts the buckle before insertion of an associated tongue plate and FIG. 2 illustrates the same buckle after insertion of the tongue plate;

DESCRIPTION OF THE INVENTION AND PREFERRED EMBODIMENTS

The present invention will hereinafter be described in further detail with reference to the illustrated embodiments.

Figure 1:
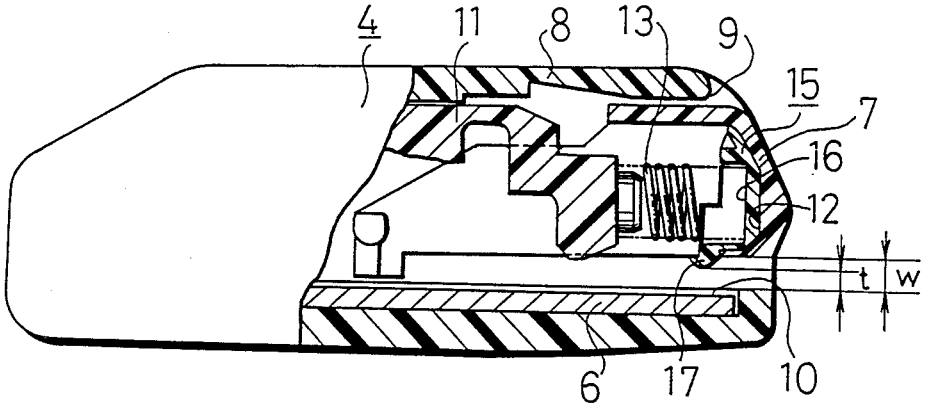
Figure 2:
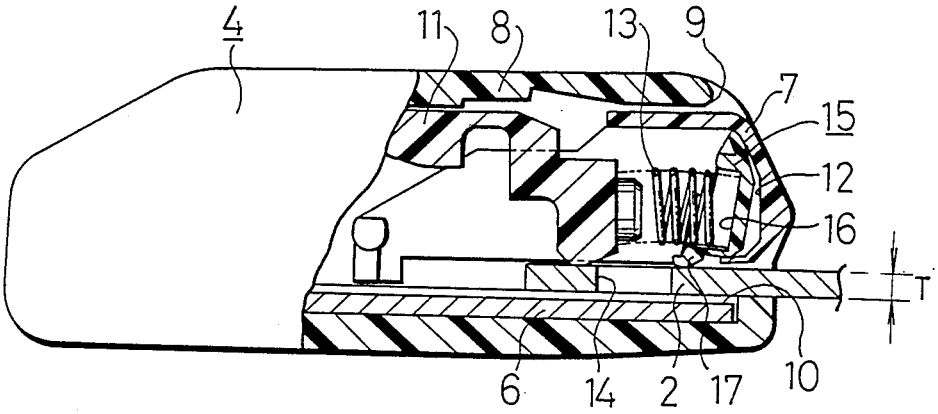

FIGS. 1–2 shows the first embodiment of this invention. These drawings are side views of the buckle according to the first embodiment, a part of said buckle being shown in longitudinal cross-section. FIG. 1 illustrates the buckle before insertion of the tongue plate, while FIG. 2 depicts the buckle after insertion of the tongue plate.

Designated at numerals 6 and 7 are buckle base and buckle button, respectively. The buckle button 7 is supported movably in parallel with the length (the "horizontal direction" as viewed in FIGS. 1 and 2) of the buckle base 6. In the course of a rearward ("leftward" as viewed in FIGS. 1 and 2) parallel movement, the buckle button 7 moves an unillustrated buckle latch piece so that the buckle latch piece is drawn out of the slot 14 formed in the vicinity of the tongue plate 2.

Numeral 8 indicates a cover made of a synthetic resin. The cover 8 defines in a front end portion (a "right end portion" as viewed in FIGS. 1 and 2) thereof an opening 9 through which a front end portion of the buckle button 7 is selectively movable back and forth. The cover 8 encloses therein the buckle button 7 and buckle base 6 except for a surface area of the buckle button 7, said surface area being exposed through the opening 9.

A support 11 is provided with the cover 8 or buckle base 6. A compression spring is provided as a button spring 13 between the support 11 and an inner wall of the buckle button 7, whereby the button spring 13 applies an outward spring force to the buckle button 7.

A clearance 10 into which a proximal end portion of the tongue plate 2 may be inserted is defined between the lower surface of the buckle button 7 and the upper surface of the buckle base 6. The buckle button 7 and buckle base 6 are both covered by the cover 8. The terms "lower" and "upper" mean the relative positions of the surfaces as viewed in the drawings. Similarly to the conventional buckle described above, the width W of the clearance 10 is greater than the thickness T of the tongue plate 2 ($W>T$).

In the buckle shown in FIGS. 1–2, a tiltable member 15 made of a synthetic resin as an integral piece is additionally provided on an inner side wall 12 of the buckle button 7. The tiltable member 15 is resiliently pressed against the inner side wall 12 by means of the button spring 13.

The tiltable member 15 is formed in the shape of a cup, and has a seat portion 16 receiving an outer end portion of the button spring thereon and a suppressing portion 17 projecting into the clearance 10 from the seat portion 16. When the tiltable member 15 is not applied with any spring force other than the spring force of the button spring 13, the suppressing portion 17 projects downwardly into the clearance 10 so that the width of the clearance 10 is reduced to a dimension t smaller than the thickness T of the tongue plate 2.

When the proximal end portion of the tongue plate 2 is inserted through the clearance 10 of the buckle 4 to connect the tongue plate 2 to the buckle 4 according to this invention, the suppressing portion 17 of the tiltable member 15 is pushed back by the tongue plate 2 so that the tiltable member 15 is tilted inwardly of the cover 8 against the spring force of the button spring 13 as shown in FIG. 2.

As a result of the tilting of the tiltable member 15 as described above, the suppressing portion 17 of the tiltable member 15 is caused to retreat from a forward point in the advancing direction of the tongue plate 2 and the proximal portion of the tongue plate 2 is inserted into the buckle 4 without hindrance by the suppressing portion 17. The unillustrated buckle latch piece on the side of buckle 4 then advances into the slot 14 of the tongue plate 2 so that the buckle 4 and tongue plate 2 are tightly connected together.

Since the spring force of the button spring 13 for pressing the buckle button 7 forward is always applied to the tiltable member 15, a downward component of the spring force is exerted to the suppressing portion 17 of the tiltable member 15. The lower edge of the suppressing portion 17 thus resiliently presses the tongue plate against the buckle base 6.

As a result, the tongue plate 2 does not rattle inside the buckle 4, thus preventing the occurrence of unpleasant noises.

Figure 3:
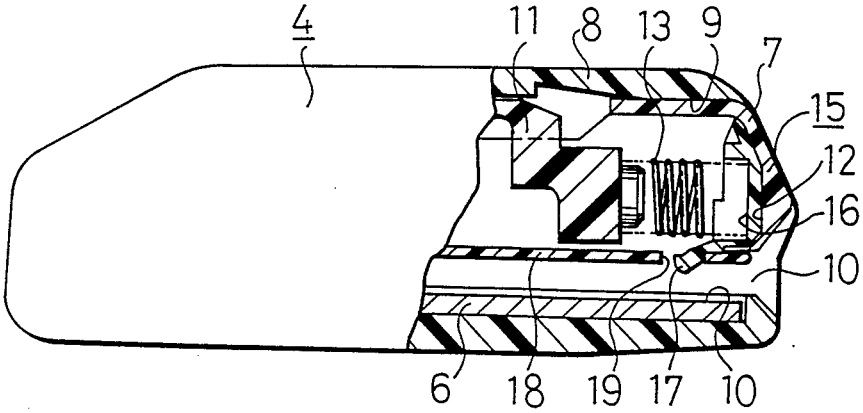
FIG. 3 is similar to FIG. 1 but shows a buckle according to a second embodiment of this invention.

FIG. 3 shows the second embodiment of this invention.

In the second embodiment, a partition 18 is formed in such a way that the interior of the cover 8 is divided into upper and lower compartments so as to guide the buckle button 7.

Through the partition 18, a through-hole 19 is formed at a position opposing the suppressing portion 17 of the tiltable member 15. The suppressing portion 17 can therefore suppress the tongue plate 2 inserted underneath the partition 18.

Since the other structural features and operations are similar to the first embodiment described above with reference to FIGS. 1–2, like elements of the structure are identified by like reference numerals and their description is omitted herein to avoid unnecessary repetition.

The third embodiment of this invention will next be described with reference to FIG. 4.

Figure 4:
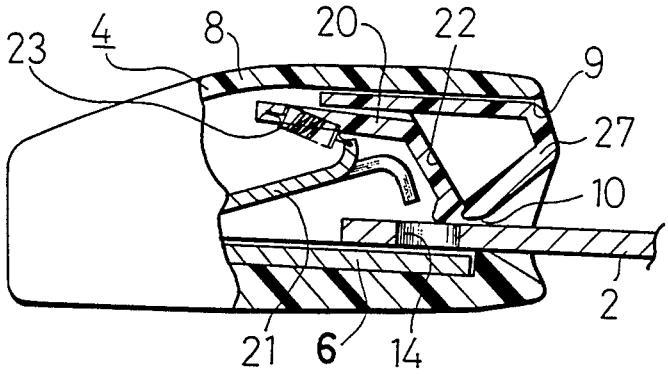
FIG. 4 is a side view of a buckle according to a third embodiment of this invention, a part of which is shown in longitudinal cross-section.
Figure 5:
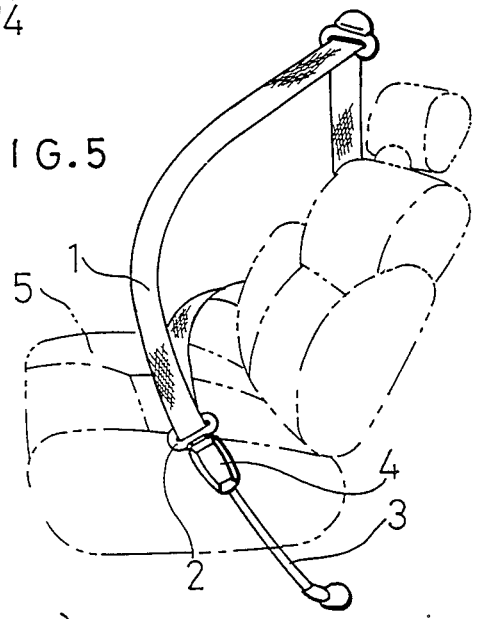
FIG. 5 is a perspective view showing the overall construction of a seat belt system.
Figure 6:
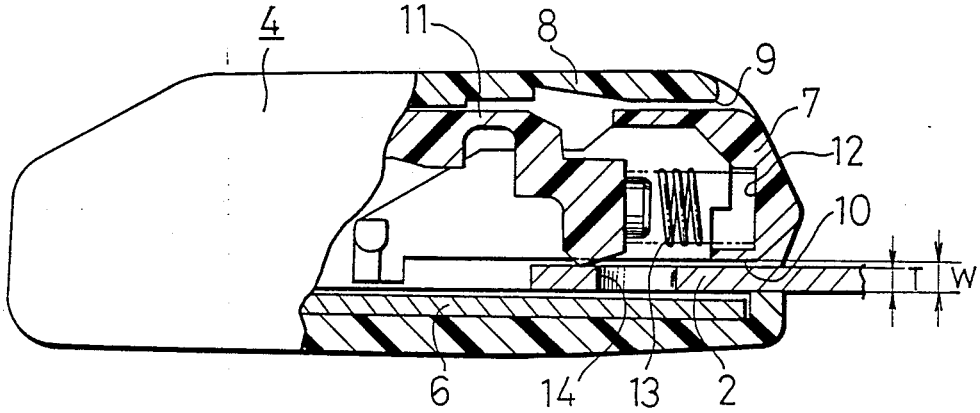
FIG. 6 (PRIOR ART)
FIG. 6 is a side view of a typical conventional buckle, a part of which is shown in longitudinal cross-section with omission of some components.

In FIG. 4, numeral 27 indicates a buckle button provided movably in parallel to the length of the buckle base 6. This parallel movement of the buckle button 27 drives a buckle latch piece 21. Designated at numeral 9 is an opening which is formed in the cover 8 and through which a portion of the buckle button 27 is selectively movable back and forth. Between the buckle button 27 and the buckle base 6, there is formed a clearance 10 through which the proximal end portion of the tongue plate 2 may be inserted.

An inner side wall 22 of the buckle button 27 is formed as a surface tilted toward the opening 9 ("rightwards" as viewed in FIG. 4) of the cover 8 as the clearance 10 is approached.

Further, a suppressing member 20 slidable on and along the tilted surface is provided inside the buckle button 27. This suppressing member 20 is shaped such that the lower end portion of the suppressing member 20 may project downwardly to an upper point in the clearance 10 when the suppressing member 20 has moved to a maximum extent toward the clearance 10.

In addition, a button spring 23 is provided between the suppressing member 20 and buckle latch piece 21, whereby an outward spring force is applied to the suppressing member 20 to bias the suppressing member 20 toward the buckle button 7.

The third embodiment is also designed in such a way that the width of the clearance between the lower edge of the suppressing member 20 and the lower edge of the opening 9 formed in the cover 8 becomes smaller than the thickness of the tongue when the suppressing member 20 has moved along the tilted surface to a maximum extent toward the clearance 10.

When the proximal end portion of the tongue plate 2 is inserted into the buckle 4 through the clearance 10 to latch the tongue plate 2 on the buckle 4 for the seat belt system, the lower end portion of the suppressing member 20 is pushed by the tongue plate 2 so that the suppressing member 20 moves rearwardly and upwardly along the tilted surface of the inner side wall 22 of the buckle button 27 against the spring force of the button spring 13 and the lower end portion of the suppressing member 20 is caused to retreat from a forward position in the advancing direction of the tongue plate 2. As a result, the proximal end portion of the tongue plate 2 can be inserted into the buckle 4 without hindrance by the lower end portion of the suppressing member 20 and the buckle latch piece 21 supported on the buckle base 6 is allowed to advance into the slot 14 of the tongue plate 2 to tightly connect the buckle 4 and tongue plate 2 together.

Even after the buckle latch piece 21 supported on the buckle base 6 has advanced into the slot 14 of the tongue plate 2 and the buckle 4 and tongue plate 2 have been tightly connected together, the lower end portion of the suppressing member 20 resiliently presses the tongue plate 2 against the lower wall of the cover 8 since the spring force of the button spring 13 is always applied to the suppressing member 20. As a result, the tongue plate 2 is prevented from rattling inside the buckle 4, thus avoiding the occurrence of unpleasant noises.

I claim:

1. In a buckle for a seat belt system, said buckle including:

a buckle base;

a buckle button provided movably in parallel with the length of the buckle base, adapted to move a buckle latch piece upon parallel movement thereof and defining in association with the buckle base a clearance through which an associated tongue plate may be inserted into the buckle;

a cover defining an opening through which a portion of the buckle button is selectively movable back and forth and enclosing therein the buckle button and buckle base except for a surface area of the buckle button, said surface area being exposed through the opening; and a button spring provided between the cover and the buckle button for applying a spring force against the buckle button in a direction to push out the buckle button, the improvement wherein the buckle button is provided with a tiltable member which has a seat portion receiving an outer end portion of the button spring thereon and a suppressing portion projecting into the clearance from the seat portion.

2. In a buckle for a seat belt system, said buckle including:

a buckle base;

a buckle button provided movably in parallel with the length of the buckle base, adapted to move a buckle latch piece upon parallel movement thereof and defining in association with the buckle base a clearance through which an associated tongue plate may be inserted into the buckle;

a cover defining an opening through which a portion of the buckle button is selectively movable back and forth and enclosing therein the buckle button and buckle base except for a surface area of the buckle button, said surface area being exposed through the opening; and a button spring provided between the buckle base and the buckle button for applying a spring force against the buckle button in a direction to push out the buckle button, the improvement whereibn the buckle button is provided with a tiltable member which has a seat portion receiving an outer end portion of the button spring thereon and a suppressing portion projecting into the clearance from the seat portion.

3. The buckle as claimed in claim 2, wherein the buckle base is provided with a support portion for supporting the button spring thereon.

4. In a buckle for a seat belt system, said buckle including:

a buckle base;

a buckle button provided movably in parallel with the length of the buckle base, adapted to move a buckle latch piece upon parallel movement thereof and defining in association with the buckle base a clearance through which an associated tongue plate may be inserted into the buckle; and a cover defining an opening through which a portion of the buckle button is selectively movable back and forth and enclosing therein the buckle button and buckle base except for a surface area of the buckle button, said surface area being exposed through the opening, the improvement wherein an inner side wall of the buckle button is formed as a wall tilted toward the opening of the cover as the clearance is approached, a suppressing member is provided inside the buckle button, the suppressing member is slidable along the tilted surface and when moved to a maximum extent toward the clearance, projects at a portion thereof into the clearance, and a biasing member is provided to bias the suppressing member toward the inner side wall of the buckle button.

5. The buckle as claimed in claim 4, wherein the buckle is additionally provided with a latch piece supported on the buckle base and releasably engageable with the tongue plate, and the biasing member is provided between the latch piece and the suppressing member.

* * * * *